US008303320B2

(12) United States Patent
Loncar et al.

(10) Patent No.: US 8,303,320 B2
(45) Date of Patent: Nov. 6, 2012

(54) CONNECTOR WITH A SECONDARY CONNECTOR

(75) Inventors: Zelimir Loncar, Zagreb (HR); Ozren Milazzi, Zagreb (HR); Vedran Kovac, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 12/948,346

(22) Filed: Nov. 17, 2010

(65) Prior Publication Data

US 2011/0117761 A1 May 19, 2011

(30) Foreign Application Priority Data

Nov. 19, 2009 (DE) ..... 10 2009 053 674

(51) Int. Cl.
*H01R 13/62* (2006.01)

(52) U.S. Cl. ..... 439/157

(58) Field of Classification Search ..... 439/152–160, 439/490, 489, 357
See application file for complete search history.

(56) References Cited

U.S. PATENT DOCUMENTS

| | | | | |
|---|---|---|---|---|
| 5,443,393 | A * | 8/1995 | Okumura et al. | 439/157 |
| 5,913,691 | A * | 6/1999 | Clark et al. | 439/157 |
| 6,325,648 | B1 | 12/2001 | Bilezikjian et al. | |
| 6,619,970 | B2 | 9/2003 | Fukushima et al. | |
| 6,755,673 | B2 | 6/2004 | Fukushima et al. | |
| 6,899,554 | B1 | 5/2005 | Osada | |
| 7,872,206 | B2 * | 1/2011 | Matsunaga et al. | 200/335 |
| 7,918,676 | B2 * | 4/2011 | Tonosaki | 439/157 |
| 2005/0098419 | A1 | 5/2005 | Matsui et al. | |

FOREIGN PATENT DOCUMENTS

| | | | |
|---|---|---|---|
| JP | 2003100382 | A | 4/2003 |
| JP | 2006351415 | A | 12/2006 |

OTHER PUBLICATIONS

European Search Report for 10186466.8-1231. dated Feb. 9, 2011.
Japanese Office Action dated Mar. 21, 2012 issued in corresponding Japanese Patent Application No. 2010-258215.

* cited by examiner

*Primary Examiner* — Jean F Duverne
(74) *Attorney, Agent, or Firm* — Sughrue Mion, PLLC

(57) ABSTRACT

A connector (1), which is connectable with a counter-connector (2), including a connector housing (3) with main contacts, which are connectable to contacts of the counter-connector (2), a lever (5), which is arranged displaceably between an open position and a closed position on the connector housing (3) and is, starting from the closed position, displaceable into an end position on the connector housing, wherein the lever (5) serves to connect the connector (1) in an insertion direction to the counter-connector by means of displacing the lever (5), as well as a secondary connector 10, which has secondary contacts, which are connectable to secondary contacts of the counter-connector (2). The secondary connector (10) is arranged displaceably between a first position and a second position on the connector housing (3), and for displacing the secondary connector the lever is coupled at least over a part of the displacement path of the lever to the secondary connector.

12 Claims, 7 Drawing Sheets

CONNECTOR WITH A SECONDARY CONNECTOR

BACKGROUND OF THE INVENTION

1. Field of the Invention

The invention relates to a connector, which is connectable to a counter-connector. The connector comprises a connector housing with main contacts, which are connectable to contacts of the counter-connector, a lever, which is arranged displaceably between an open position and a closed position on the connector housing and is, starting from the closed position to an end position on the connector housing, wherein the lever serves to connect the connector to the counter-connector by means of displacing the lever, as well as a secondary connector, which has secondary contacts, which are connectable to secondary contacts of the counter-connector. The invention relates especially to a connector for connecting leads, in which high currents flow.

2. Background

Such a connector is known from U.S. Pat. No. 6,755,673 as well as from U.S. Pat. No. 6,619,970. The secondary connector is part of the lever, wherein the lever is pivoted, starting from the open position, into the closed position, to connect the connector to the counter-connector by means of setting contours on the lever and setting cams on the counter-connector. The lever with the setting contours serves to be able to connect the connector to the counter-connector with a low force effort. Furthermore, a smooth and parallel insertion of the connector is enabled, which is especial necessary in connector arrangements with a multitude of contacts to be connected.

So that the correct connection of the connector arrangement can be checked, a secondary connector is provided, which has contacts, which can be connected to contacts of a secondary counter-connector. The secondary connector is part of the lever. The lever can be transferred, starting from the closed position, in which the main contacts of the connector arrangement are connected to each other, by displacement into an end position. In the end position, the contacts of the secondary connector are connected to the contacts of the secondary counter-connector, so that by means of a control device, a switch can be actuated, which closes a main circuit, so that only then the main contacts carry a current. This is especially necessary in connector arrangements, in which high currents flow. Thus, the danger for the operator is reduced, to get into contact with current carrying components.

SUMMARY OF THE INVENTION

The object of the present invention is, to provide a connector of the above named type, in which the lever is free of electric contacts.

The object is solved by a connector having the characteristics described below.

The secondary connector is, thus, a separate component, which is guided displaceably on the connector housing. A mechanical coupling exists between the lever and the secondary connector, wherein the lever itself has no contact elements.

The connector is connected to the counter-connector by means of displacing the lever from the open position to the closed position, whereby also the main contacts of the connector are connected to those of the counter-connector. When transferring the lever from the closed position to the end position, the connector is not further displaced and the main contacts remain still in contact with each other.

Preferably, the secondary connector is guided slidably on the connector housing, wherein it is especially advantageous, when the connector is slideable in the insertion direction of the connector. Thus, the cables of the secondary counter-connector, which are on the counter-connector, can be installed in the same direction, as the cables of the main contacts of the counter-connector. This achieves a more compact construction, as no cables have to be installed transversally to the cables of the main contacts, whereby a small space is required. Furthermore, in case of cables extending transversally to the cables of the main contacts, these might have to be sealed separately relative to a component, on which the counter-connector is mounted.

Furthermore, the secondary connector is already inserted partially into the secondary counter-connector, while connecting the connector to the counter-connector, and is arranged in the completely inserted connector already in a starting position, starting from which the secondary connector only has to be displaced by a small displacement amount, to be completely inserted. Thus, a small displacement path of the lever is necessary, across which the secondary connector is moved, whereby again a small installation space has to be provided for the displacement of the lever.

The lever is preferably provided pivotably between the open position and the closed position and is provided displaceably from the closed position to the end position on the connector housing. In this case, the lever is slideable transversally to the insertion direction of the connector.

The secondary connector serves to actuate a separation switch, by means of which a main lead, to which the main contacts are connected, can be switched on or off. Hereby, it should be prevented, that operators unintentionally come into contact with contacts carrying a current. Only when the connector is completely inserted, the secondary connector can be connected and the main leads can be switched on. To ensure, while decoupling the connector, a time delay between the decoupling of the secondary connector and, thus, the switching-off of the main leads, and the decoupling of the whole connector, it is provided, that initially for decoupling the secondary connector, the lever has to be displaced transversally to the insertion direction of the connector and, then, has to be pivoted, so that the connector is decoupled against the insertion direction. To increase the time delay, a locking device can additionally be provided, which prevents a displacement of the lever from the closed position to the open position. Thus, initially a pivoting of the lever for the complete decoupling of the connector is also prevented. In this case, the locking device can be unlocked manually, to enable a movement of the lever into the open position. Thus, the lever can initially be displaced from the end position to the closed position. Then, the locking device has to be initially manually unlocked, so that then the lever can be pivoted into the open position. Thus, an additional manual actuation has to be carried out, after the secondary connector is already decoupled, whereby a greater time delay of the complete decoupling process of the connector results. Thus, sufficient time is available, that after the decoupling of the secondary connector and, thus, when switching off the main leads, no current is present anymore at the main contacts.

The locking device has at least one locking arm, which engages behind the lever in its closed position and blocks the same from displacing into the open position.

In this case it can be provided, that the locking arm can be unlocked in the closed position of the lever and is protected from unlocking in the end position of the lever. In order to avoid unlocking, the lever can be arranged such, that it is not manually accessible anymore or that it is blocked by a further component, e.g. of the lever, from moving into an unlocking position.

The coupling between the lever and the secondary connector can be achieved such, that a ramp arrangement is provided, by means of which by displacement of the lever from the closed position into the end position, the lever is displaced.

For this, one of the components, namely the lever or the secondary connector, can at least have one groove, which extends in the closed position of the lever at least partially inclined to the insertion direction of the connector. The other of the two components, namely the secondary connector or the lever, has a cam, which engages in the at least one groove. In this case, the cams and the groove are arranged such, that they are transferred by means of displacing the lever starting from the closed position in direction towards the end position in an in each other engaged condition, wherein it is provided, that these do not yet engage in each other in the closed position of the lever, so that the lever can be freely pivoted.

Furthermore, the connector housing has two bearing cams. The lever has two bearing grooves, with which the same is plugged onto the bearing cams and is fixed to these, wherein the lever is held pivotably around the bearing cams. The bearing grooves are formed straight, so that these extend transversally to the insertion direction of the connector, when the lever is in the closed position, or extends in direction of the displacement path of the lever from the closed position to the end position.

The bearing grooves have respectively at one end an expansion, wherein the lever is pivotable around the bearing cams, when the bearing cams are arranged in the expansions.

The bearing cams are, at least across a portion of their length, flattened in cross-section, wherein the lever is guided axially displaceably with the bearing grooves relative to the bearing cams. The smallest width of the flattened cross-section of the bearing cams is adapted such to the width of the bearing grooves, that the lever is prevented from pivoting.

BRIEF DESCRIPTION OF THE DRAWINGS

In the following a preferred embodiment is described in detail using the drawings. It shows.

DETAILED DESCRIPTION OF THE PREFERRED EMBODIMENTS

Figure 1:
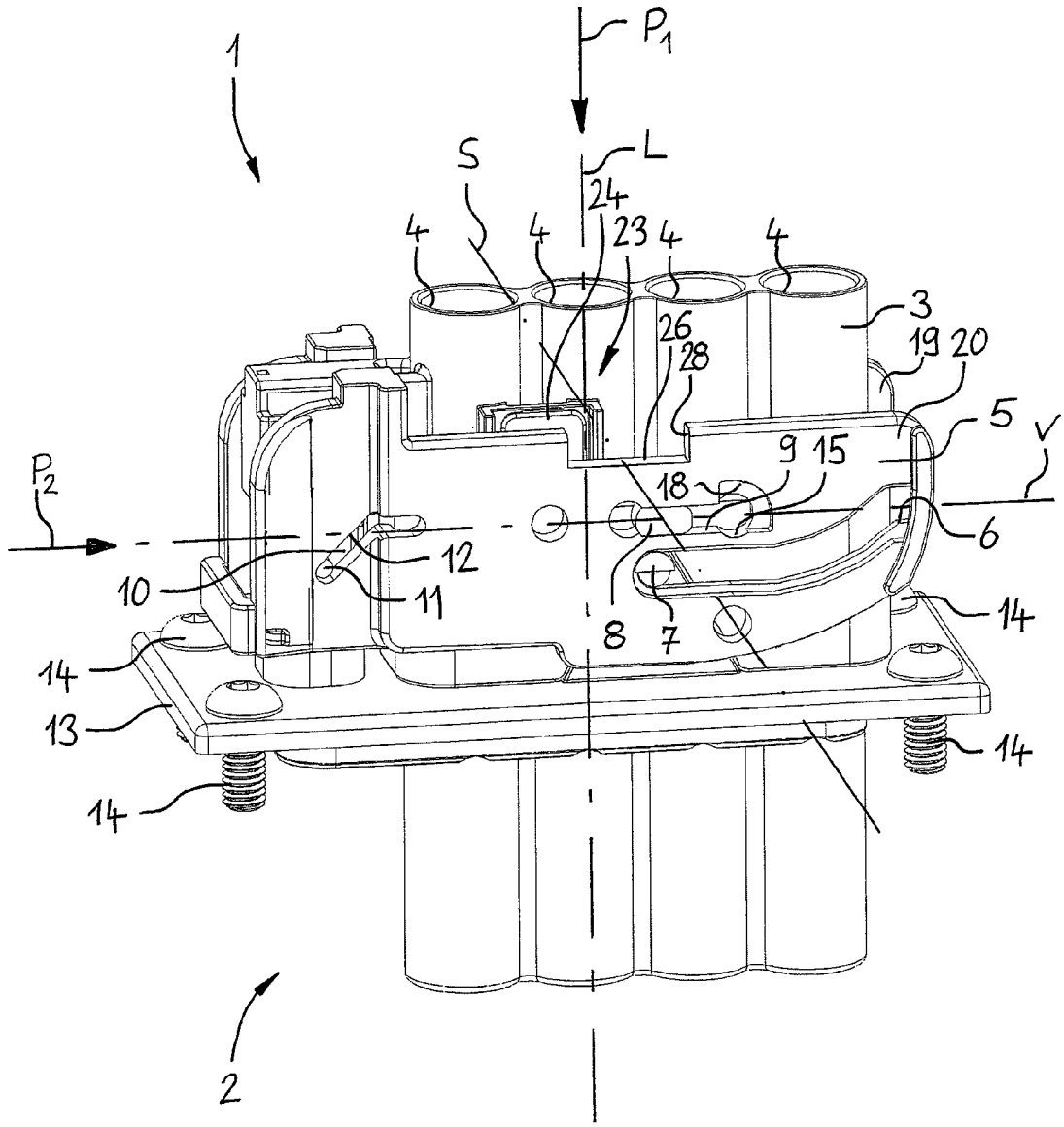
FIG. 1 a perspective view of a connector according to the invention in a condition, connected to a counter-connector, FIG. 2 a side view of the connector and of the counter-connector according to the invention in the non-connected condition, FIG. 3 a side view of the connector and of the counter-connector according to FIG. 1 in a starting position before connecting, wherein the lever is in its open position, FIG. 4 a side view of the connector and of the counter-connector according to FIG. 1 in a connected position, wherein the lever is in its closed position, FIG. 5 a longitudinal sectional view of the connector and the counter-connector according to FIG. 4, FIG. 6 a side view of the connector and of the counter-connector according to FIG. 1 in a connected position, wherein the lever is in its end position, FIG. 7 a longitudinal sectional view of the connector and the counter-connector according to FIG. 6, FIG. 8 a perspective representation of the lever, FIG. 9 a perspective representation of the connector housing, FIG. 10 a perspective representation of the secondary connector and FIG. 11 a partial longitudinal sectional view through the locking device.
Figure 2:
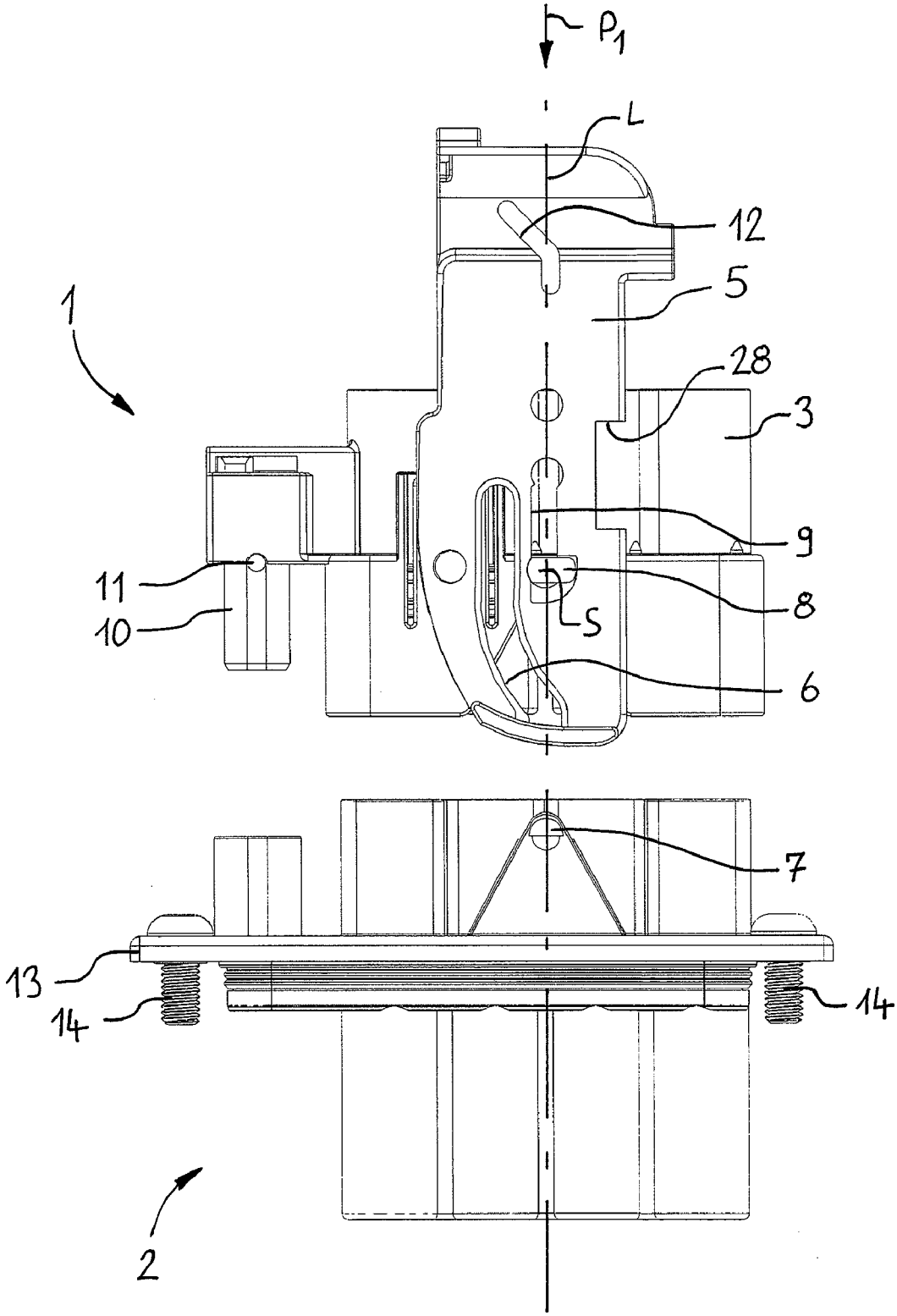
Figure 3:
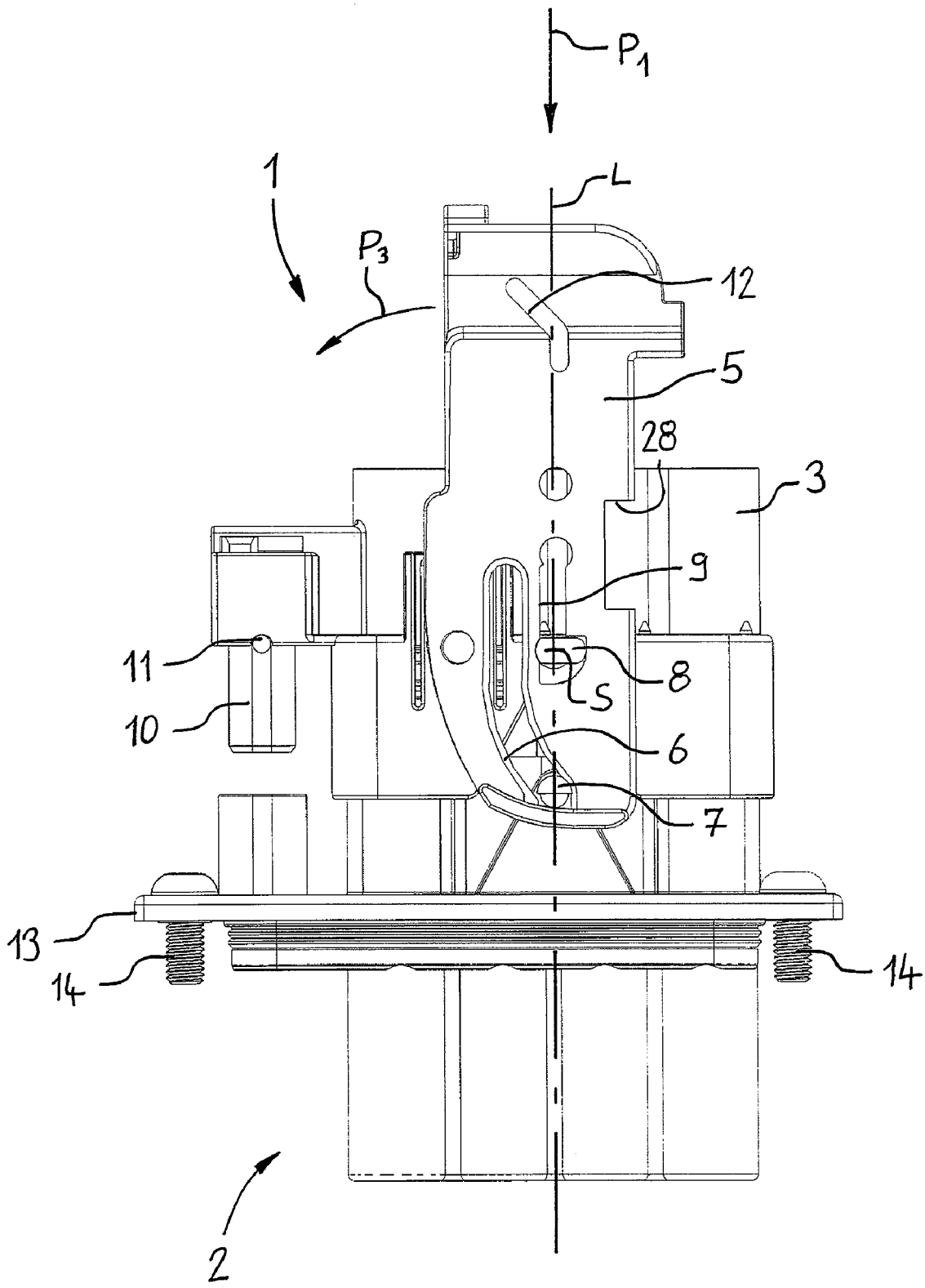
Figure 5:
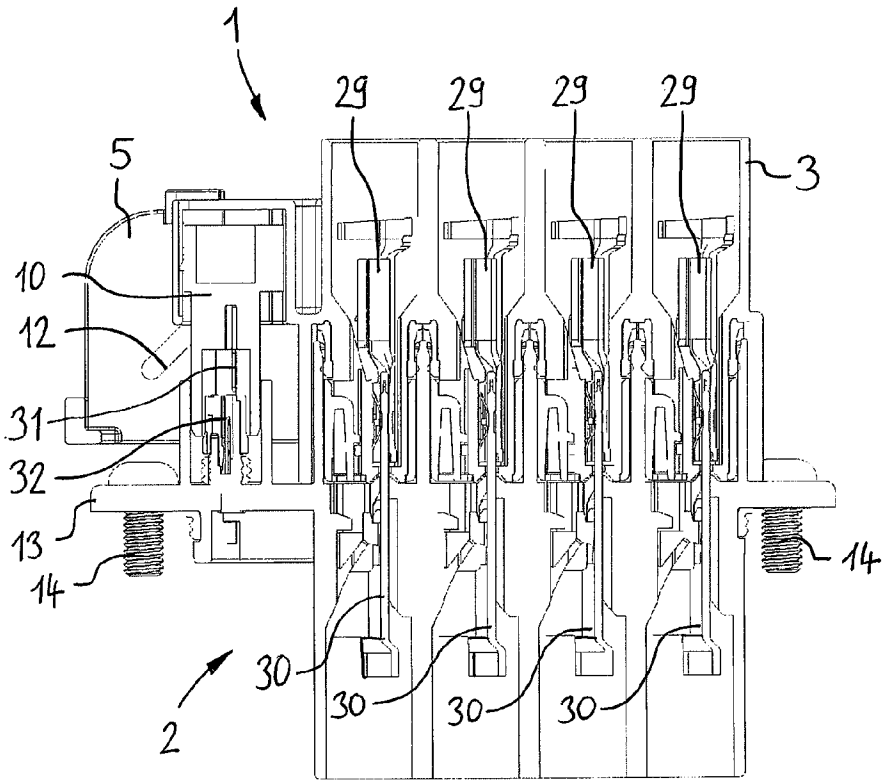
Figure 4:
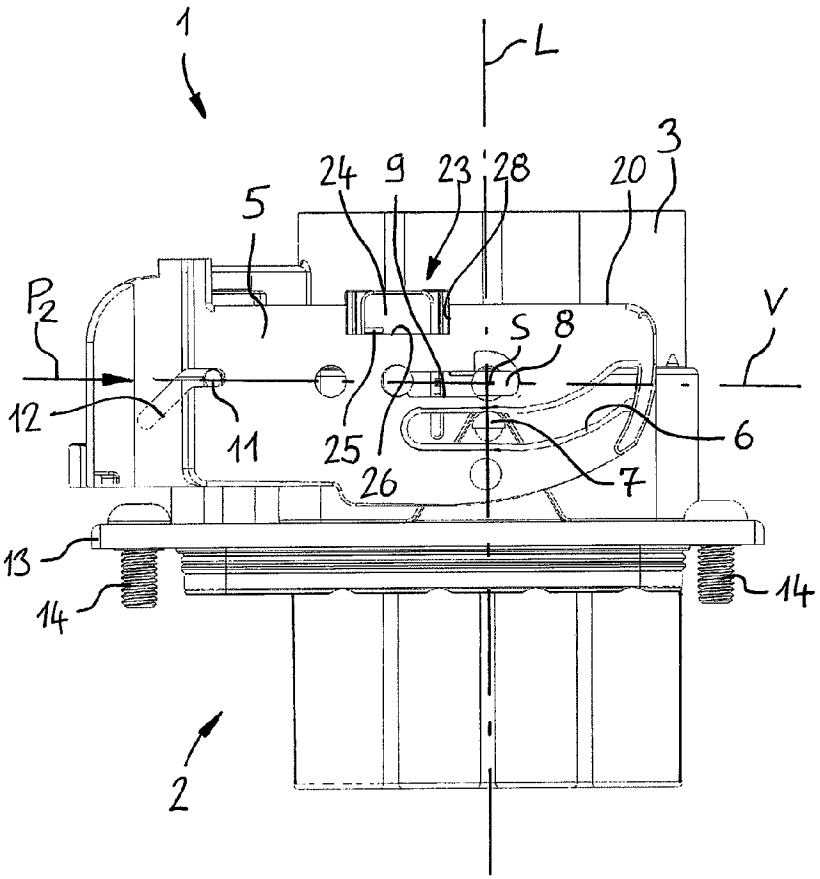
Figure 7:
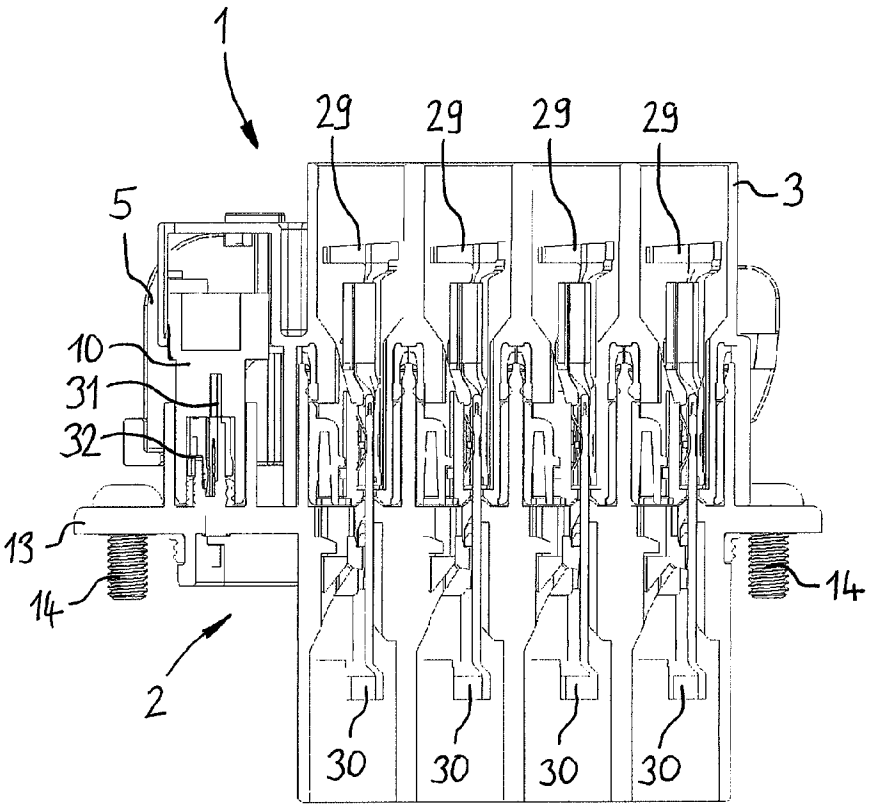

FIG. 1 shows a perspective representation of a connector 1 according to the invention in a condition connected with a counter-connector 2. The connector 1 comprises a connector housing 3, which has four accommodation chambers 4, in which, respectively, main contacts 29 in form of female contacts for main leads are provided (see FIGS. 5 and 7). The main contacts 29 are connected to corresponding main contacts 30 in form of pin contacts of the counter-connector 2 (see FIGS. 5 and 7). On the connector housing 3, a lever 5 is arranged, which is pivotable around a pivot axis S of the connector housing 3. The lever 5 serves, as in known connectors with levers, to connect the connector 1 to the counter-connector 2 with a small force. For this, the lever 5 is essentially U-like and has at its both legs 19, 20, respectively, a setting curve 6, into which setting cams 7 of the counter-connector are insertable. The lever 5 is pivotable between an open position, shown in FIG. 3 and a closed position, shown in FIG. 4. During the insertion of the connector 1 into the counter-connector 2, the setting cams 7 of the counter-connector 2 are inserted into the setting curves 6, wherein the lever 5 is in the open position. During the following pivoting of the lever 5 from the open position to the closed position in the direction of the arrow $P_3$ according to FIG. 3, the connector 1 is pulled in insertion direction $P_1$, which is aligned parallel to a longitudinal axis L of the connector, deeper into the counter-connector 2, as the setting curve 6 is formed such, that this acts with a force on the setting cams 7 during the pivoting of the lever 5. By the lever effect of the lever 5, only a small force is necessary, to connect, during the pulling of the connector 1 closer to the counter-connector 2, the main contacts 29 of the connector (see FIGS. 5 and 7) to the main contacts of the counter-connector 2.

Figure 6:
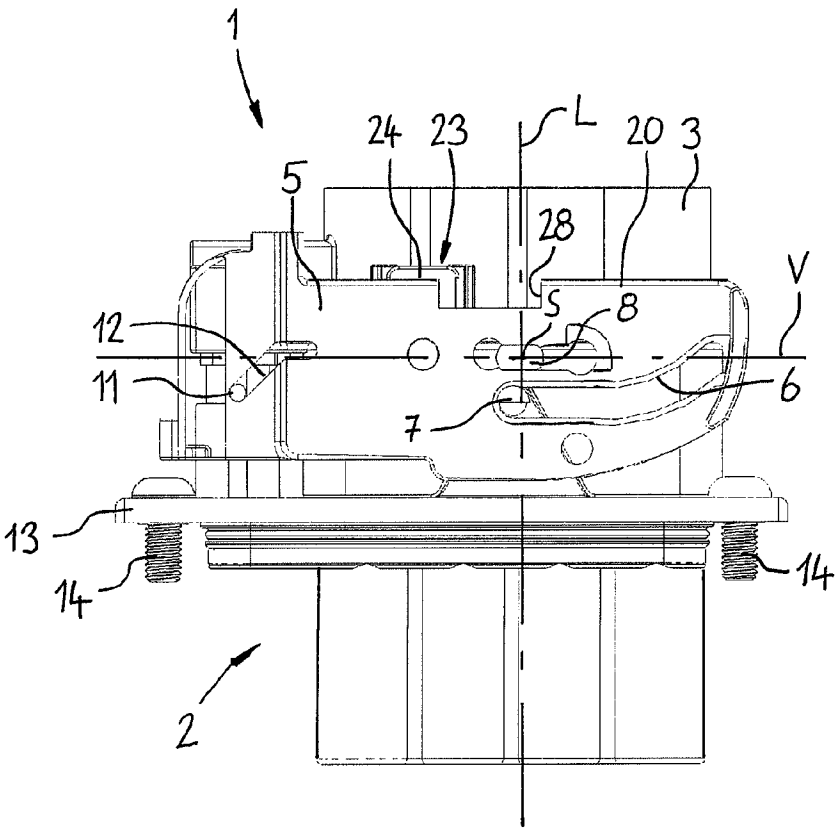

To ensure a pivoting of the lever 5, the same has bearing grooves 9 in the legs 19, 20, with which the lever 5 is plugged onto the bearing cams 8 of the connector housing 3. Furthermore, by means of this connection, the lever 5 can be displaced along a displacement axis V from the closed position shown in FIG. 4 into the end position, shown in FIG. 6, transversally to the longitudinal axis L.

Furthermore, there is a secondary connector 10 arranged parallel slideable to the longitudinal axis L on the connector housing 3. During the sliding of the lever 5 from the closed position into the end position, the secondary connector 10 is coupled such to the lever 5, that the secondary contacts of the secondary connector 10 are connected to the secondary contacts of the counter-connector 2. For this, the secondary connector 10 has laterally projecting cams 11, which are guided along the displacement path of the lever 5 in grooves 12 of the legs 19, 20 of the lever 5.

The counter-connector 2 serves to be mounted on a component, e.g. a motor vehicle and has, for this, a plate portion 13, which can be attached by attachment screws 14 on the component, e.g. the motor vehicle.

The principal function of the lever, namely to connect the connector 1 with a small effort to the counter-connector 2, is not described in detail in the following, as it is known form the State of Art. In this connection it is referred to the citations named in the introductory part of the description.

Figure 8:
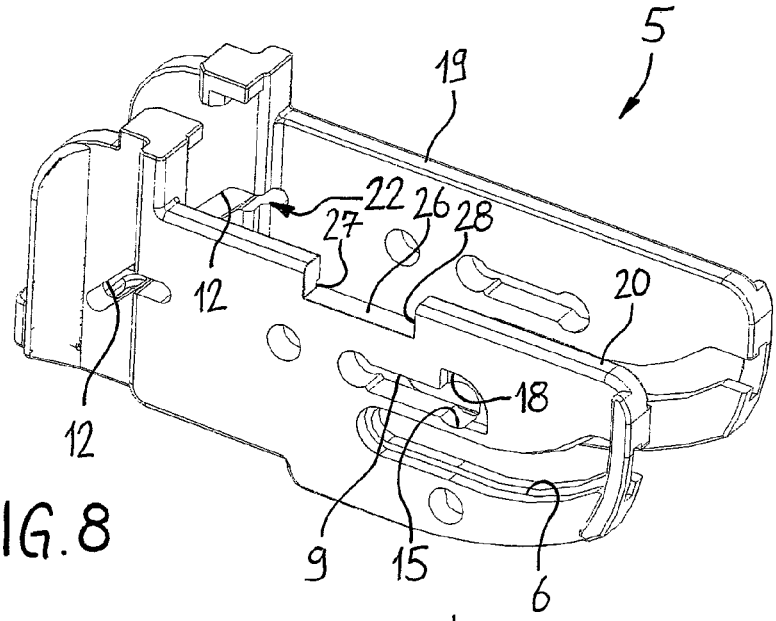
Figure 9:
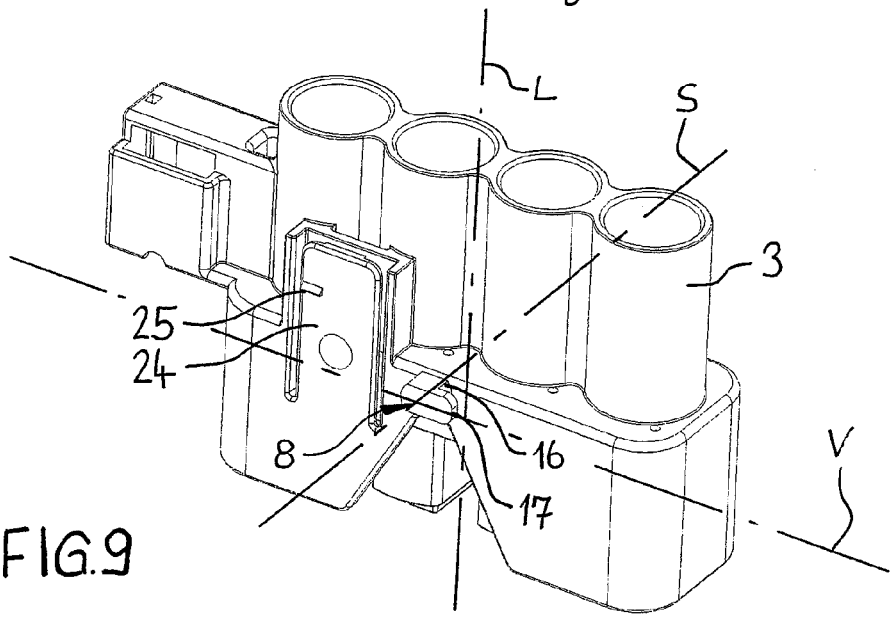

In the following, the connection of the lever 5 on the connector housing 3 is described in more detail. For this, the lever 5 has bearing grooves 9, which are plugged onto the bearing cams 8. In the open position of the lever 5, the bearing cams 8 are arranged within an expansion 15 of the bearing grooves 9. As it is especially visible in FIG. 9, the bearing cams 8 project laterally from the connector housing 3 and have a shaft 16 arranged close to the connector housing and a head 17, expanded in cross-section, arranged distanced to the connector housing. In total, the bearing cam 9 has the same width, when seen in longitudinal direction, and is flattened in its extension. The bearing cam 16 is in the displacement direction V longer, wherein the head 17 projects in this direction beyond the shaft 16. The bearing cams 8 are formed approximately as wide in longitudinal direction L, as the bearing groove 9 is wide. In displacement direction V, the shaft 16 is, however, longer than the width of the bearing groove 9 (FIG. 8), so that the lever 5 can only then be displaced relative to the bearing cams 8, when the bearing grooves 9 are aligned parallel to the displacement direction V, so that the bearing cams 8 can be pushed into the bearing grooves 9. In all other pivoting positions of the lever 5, the bearing cams 8 cannot enter the bearing grooves 9, starting from the expansion 15, as the bearing cams 8 are longer than the width of the bearing grooves 9. To allow still a delimiting of the pivot path, a recess 18 is arranged around the expansion 15, wherein the recess 18 extends across an angle of 90°. The portion of the head 17, projecting beyond the shaft 16, enters the recess 18, so that the lever 5 can be displaced across a pivot path of 90°, as it is especially visible in FIGS. 3 and 4.

For the coupling between the lever 5 and the secondary connector 10, the grooves 12 are provided in the legs 19, 20. The grooves 12 extend initially parallel to the bearing grooves 9 and start in a first portion of the legs 19, 20 and extend away from the bearing grooves 9. Following the portions, extending parallel to the bearing grooves 9, portions of the grooves 12 are attached, which, when seen in the closed position of the lever 5, extend further away from the bearing grooves 9 and approach the counter-connector 2 (see FIG. 1). At least the portions of the grooves 12, approaching each other, extend in second portions of the legs 19, 20, wherein the first portions of the legs 19, 20 are further distanced away from each other than the second portions, as it is visible in FIG. 8. Thus, in the transition between the two portions a shoulder 21 is formed, which forms an opening 22 into the respective groove 12.

Figure 10:
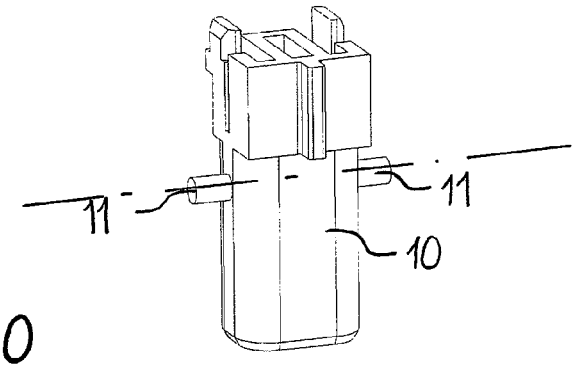

The cams 11 of the secondary connector 10 project laterally from the secondary connector 10 and extend parallel to the pivot axis S (FIG. 10). The cams 11 fit between the first portions of the legs 19, 20, so that by means of pivoting the lever 5 into the closed position, the secondary connector 10 enters with the cams 11 between the two legs 19, 20, till the cams 11 are in front of the openings 22 of the grooves 12. By means of displacing the lever 5 in the direction of the arrow $P_2$ (FIG. 4) parallel to the displacement axis V, the cams 11 enter then the grooves 12 and are displaced during the displacement of the lever 5 by the inclined portions of the grooves 12 in direction towards the counter-connector 2, so that the secondary connector 10 is connected. The detaching of the secondary connector 10 is carried analogously by means of pushing back the lever 5, wherein the cams 11 abut the grooves 12 and are displaced by these against the insertion direction $P_1$.

Of special advantage is, that the secondary connector 10 is inserted in the same insertion direction $P_1$ as the connector 1. Thus, already while connecting the connector 1 to the counter-connector 2, i.e. while transferring the lever 5 from the open position into the closed position, the secondary connector 10 is already inserted partially into a secondary counter-connector 33, which is part of the counter-connector 22, without bringing the secondary contacts 31, 32 in contact to each other. A complete connection of the secondary connector 10 to the secondary counter-connector 33 and a contact of the secondary contacts 31, 32 is only achieved by means of axial displacement of the lever 5 from the closed position into the end position. By means of the partial insertion of the secondary connector 10 before the complete connection, the path, which the secondary connector 10 and, thus, the lever 5 has to pass is smaller, as if the whole insertion path of the secondary connector 10 with the lever 5 would have to be achieved, as this is the case in known connectors.

Furthermore, a locking device 23 is provided on the connector housing 3. In this case, it is a so-called CPA Device (Connector position assurance device). The locking device 23 serves to secure the lever 5 at least in the closed position against pivoting. The locking device 23 comprises a locking arm 24, which is arranged within the legs 19, 20 of the lever 5, wherein one locking arm 24 is assigned to each leg 19, 20. A locking projection 25 is provided respectively on the locking arm 24. While pivoting the lever 5 from the open position into the closed position, the locking projection 25 engages behind a locking face 26 of the lever 5 and blocks the lever 5 from pivoting back into the open position. For moving the lever 5 back into the open position, initially the locking arm 24 has to be pushed inwardly, so that the locking projection 25 does not engage anymore behind the locking face 26 and the lever 5 can be pivoted into the open position. The locking projection 25 is, in this case, formed such, that the moving of the lever 5 from the open position to the closed position can be carried out without manually actuating the locking arm 24. When moving the lever 5 from the open position into the closed position, the locking projecting 25 snaps automatically behind the locking face 26 of the lever 5.

Figure 11:
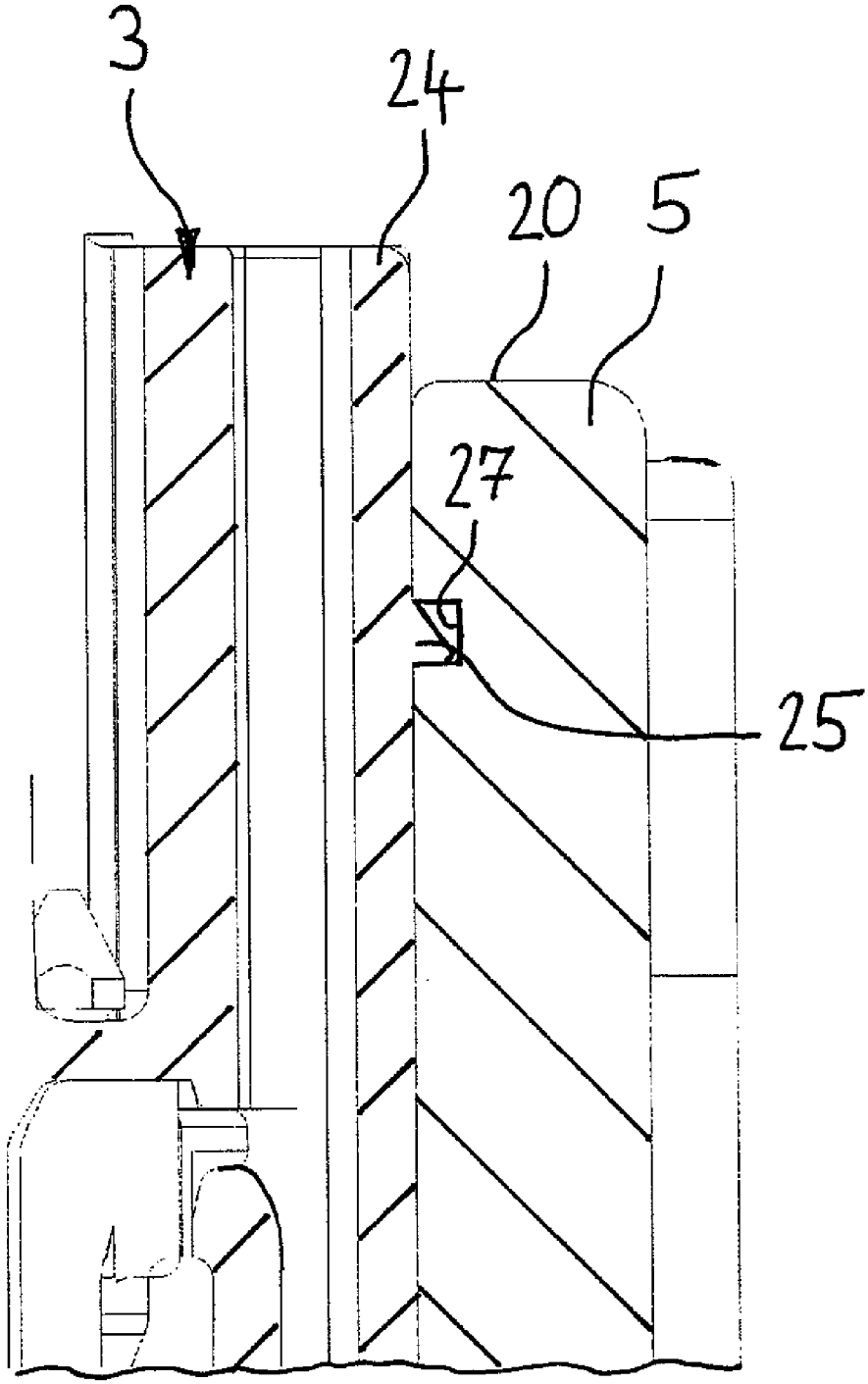

The locking face 26 is, respectively, part of a locking groove 27 (FIG. 11) on the inner side of the legs 19, 20, which extends parallel to the bearing grooves 9. Thus, the lever 5 can be displaced in the displacement direction V. In the end position of the lever 5, the locking arm 24 is respectively covered by a part of the legs 19, 20, so that the same is not manually accessible. Only in the closed position of the lever 5, the locking arm 24 can be manually reached and unlocked.

Reference Numerals List

1 connector
2 counter connector
3 connector housing
4 accommodation chamber
5 lever
6 setting curve
7 setting cam
8 bearing cam
9 bearing groove
10 secondary connector
11 cam
12 groove
13 plate portion
14 attachment screw
15 expansion
16 shaft
17 head
18 recess
19 leg
20 leg
21 shoulder
22 opening
23 locking device
24 locking arm
25 locking projection
26 locking face
27 locking groove

28 recess
29 main contact (female contact)
30 main contact (pin contact)
31 secondary contact (pin contact)
32 secondary contact (female contact)
33 secondary counter connector
L longitudinal axis
$P_1$ insertion direction
$P_2$ displacement direction
$P_3$ pivot direction
S pivot axis
V displacement axis

The invention claimed is:

1. A connector, which is connectable with a counter-connector, comprising:

a connector housing with main contacts, which are connectable to contacts of the counter-connector, a lever, which is arranged displaceably between an open position and a closed position on the connector housing and is, starting from the closed position, displaceable into an end position on the connector housing, wherein the lever serves to connect the connector in an insertion direction to the counter-connector by means of displacing the lever, as well as a secondary connector, which has secondary contacts, which are connectable to secondary contacts of the counter-connector, wherein;

the secondary connector is displaced between a first position and a second position in respect to the connector housing upon movement of the lever from the closed position to the end position, and for displacing the secondary connector, the lever is coupled at least over a part of the displacement path of the lever to the secondary connector.

2. The connector according to claim 1, wherein the secondary connector is guided slidably on the connector housing.

3. The connector according to claim 2, wherein the secondary connector is slideable in insertion direction of the connector.

4. The connector according to claim 1, wherein the lever is pivotable between an open position and a closed position and slidable from the closed position into the end position.

5. The connector according to claim 1, further comprising a locking device which prevents a displacement of the lever from the closed position into the open position.

6. The connector according to claim 5, wherein the locking device comprises at least one locking arm, which engages behind the lever in its closed position and blocks the lever against displacing into the open position.

7. The connector according to claim 6, wherein the locking arm is configured to be unlocked in the closed position of the lever and is protected in the end position of the lever against unlocking.

8. The connector according claim 1, where the secondary connector is coupled to the lever, when displacing the lever from the closed position into the end position, by means of a ramp arrangement.

9. The connector according to claim 8, wherein one of the lever and the secondary connector, has at least one groove, which, in the closed position of the lever, extends at least partially inclined to the insertion direction of the connector and wherein the other of the secondary connector and the lever, has a cam, which engages in the at least one groove.

10. The connector according claim 1 wherein the connector housing has bearing cams and the lever has two bearing grooves, by means of which the lever is plugged onto the bearing cams and held pivotably relative thereto.

11. The connector according to claim 10, wherein the bearing grooves have, respectively, at one end an expansion, and the lever is pivotable, when the bearing cams are arranged in the expansion, around the same.

12. The connector according to claim 11, wherein the bearing cams are flattened in cross-section and the lever is guided axially displaceable with the bearing grooves relative to the bearing cams, and wherein the smallest width of the bearing cams is adapted to the width of the bearing grooves such, that the lever is prevented from pivoting.

* * * * *